US006758202B2

(12) United States Patent
Russell et al.

(10) Patent No.: US 6,758,202 B2
(45) Date of Patent: Jul. 6, 2004

(54) CONTROL METHOD FOR ENGINE

(75) Inventors: John D. Russell, Farmington Hills, MI (US); Mrdjan J. Jankovic, Birmingham, MI (US)

(73) Assignee: Ford Global Technologies, LLC, Dearborn, AL (US)

( * ) Notice: Subject to any disclaimer, the term of this patent is extended or adjusted under 35 U.S.C. 154(b) by 0 days.

(21) Appl. No.: 10/347,098

(22) Filed: Jan. 21, 2003

(65) Prior Publication Data

US 2003/0111067 A1 Jun. 19, 2003

Related U.S. Application Data

(63) Continuation of application No. 09/682,204, filed on Aug. 6, 2001.

(60) Provisional application No. 60/239,791, filed on Oct. 12, 2000.

(51) Int. Cl.[7] ..... F02D 41/30; F02B 75/04

(52) U.S. Cl. ..... 123/685; 123/78 E; 123/78 F

(58) Field of Search ..... 123/198 D, 198 DB, 123/198 DC, 198 F, 48 B, 78 E, 78 F, 685

(56) References Cited

FOREIGN PATENT DOCUMENTS

| | | | |
|---|---|---|---|
| JP | 230523 | * 11/1985 | ..... F02D/15/04 |
| JP | 230524 | * 11/1985 | ..... F02D/15/04 |
| JP | 230526 | * 11/1985 | ..... F02D/15/04 |
| JP | 230548 | * 11/1985 | ..... F02D/15/04 |
| JP | 285237 | * 11/1988 | ..... F02D/15/02 |

* cited by examiner

*Primary Examiner*—Hai Huynh
(74) *Attorney, Agent, or Firm*—Allan J. Lippa

(57) ABSTRACT

A control method adjusts fuel injection into an engine having a variable compression ratio. The method determines the cylinder air amount based on various sensors and the current compression ratio. The disclosed fuel injection method can perform both open loop and closed loop control. A method is also disclosed for putting the compression ratio to a base value during engine shutdown so that subsequent engine starts occur with a consistent compression ratio.

16 Claims, 14 Drawing Sheets

BASE STATE
(Low Compression Mode)

EXTENDED STATE
(High Compression Mode)

CONTROL METHOD FOR ENGINE

CROSS REFERENCE TO RELATED APPLICATIONS

This is a continuation of utility patent application Ser. No. 09/682,204, filed Aug. 6, 2001, titled "CONTROL METHOD FOR ENGINE", assigned to the same assignee as the present application, which claims priority to provisional application No. 60/239,791 filed Oct. 12, 2000. The present application incorporates by reference the entire contents of application Ser. No. 09/682,204, filed Aug 6, 2001, and provisional application No. 60/239,791, filed Oct. 12, 2000.

BACKGROUND OF INVENTION

The field of the present invention relates to control of an internal combustion engine having a variable compression ratio, and in particular to fuel injection control.

Variable compression ratio (VCR) engines are equipped with various mechanisms to adjust the volumetric ratio between piston top dead center and piston bottom dead center. Such a VCR engine changes the compression depending on various operating conditions to provide improved performance.

However, the inventors herein have recognized disadvantages of such VCR engines. For example, changing compression ratio during engine operation may introduce an air-fuel ratio error. In particular, since changing compression ratio changes engine breathing characteristics, a change in inducted airflow can result in an air-fuel ratio error. This air-fuel ratio error can increase emissions.

The inventors have further recognized that conventional feedback air-fuel ratio control may not effectively minimize these air-fuel ratio errors under all operating conditions. In other words, simply relying on adjustments based on exhaust gas oxygen sensors may provide a degraded response in certain operating conditions.

Finally, the inventors have recognized that the air-fuel ratio error can be especially difficult to minimize when the engine is operated under open loop air-fuel ratio control, since no feedback mechanism is provided to compensate for the air-fuel ratio error.

SUMMARY OF INVENTION

Disadvantages of prior approaches are overcome by a method for operating an internal combustion engine, the engine having a variable compression ratio, the method comprising: determining a fuel injection amount based on a parameter indicative of a compression ratio of the variable compression ratio engine; and injecting fuel into the engine based on said fuel injection amount.

By taking into account variation in engine compression ratio, more accurate air-fuel ratio can be obtained. This can be especially true during transients of compression ratio. Such improved air-fuel ratio control can decrease emissions.

Note that there are various ways to calculate fuel injection amount based on compression ratio. For example, it can be done by adjusting engine breathing maps, or adjusting engine-operating parameters. Further, it can be done using manifold pressure sensor based fueling systems or mass airflow sensor based fueling systems. Various other embodiments are described later herein.

Also, note that there are various ways to inject fuel into the engine based on a fuel injection amount. For example, adjusting a fueling command signal, or changing a number of times fuel is injected, or changing fuel vapor introduced via an evaporative emissions system can affect injected fuel. Any such method can be used according to the present invention. Various other embodiments are described later herein.

Finally, note that there are various other features of the invention that can be performed in various ways. For example, any type of variable compression ratio can be used, such as one where connected rod length changes or where piston height changes.

BRIEF DESCRIPTION OF DRAWINGS

For a complete understanding of the present invention and the advantages thereof, reference is now made to the following description, taken in conjunction with the accompanying drawings in which like reference numbers indicate like features, and wherein.

DETAILED DESCRIPTION

Figure 1:
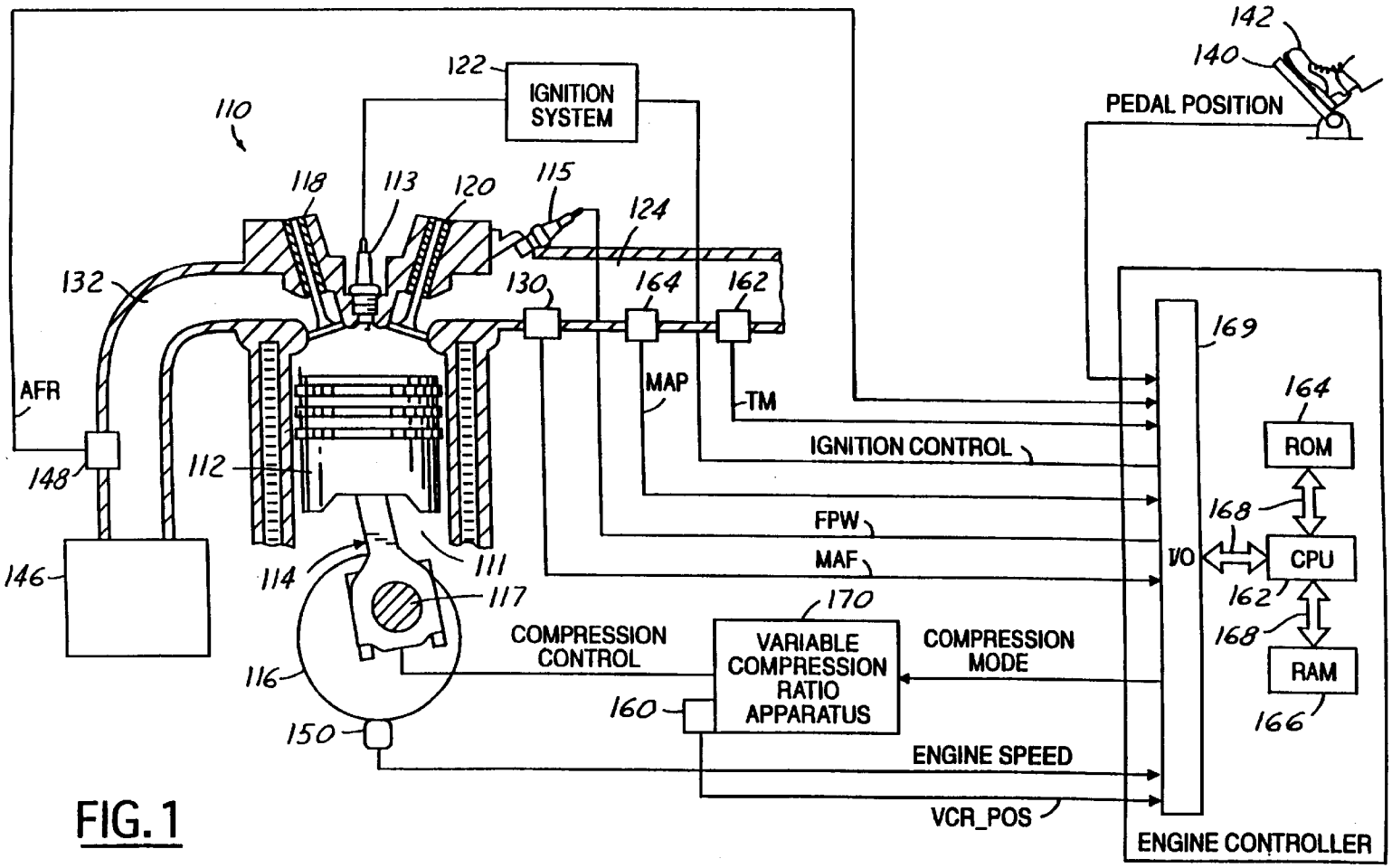
FIG. 1 is a diagram of an exemplary system for varying the compression ratio of an internal combustion engine.

FIG. 1 shows a diagram of a system for operating a variable compression ratio internal combustion engine in accordance with a preferred embodiment of the present invention. The engine 110 shown in FIG. 1, by way of example and not limitation, is a gasoline four-stroke direct fuel injection (DFI) internal combustion engine having a plurality of cylinders (only one shown), each of the cylinders having a combustion chamber 111 and corresponding fuel injector 113, spark plug 115, intake manifold 124, exhaust manifold 132, and reciprocating piston 112. The engine 110, however, can be any internal combustion engine, such as a port fuel injection (PFI) or diesel engine, having one or more reciprocating pistons as shown in FIG. 1. Each piston of the internal combustion engine is coupled to a fixed-length connecting rod 114 on one end, and to a crankpin. 117 of a crankshaft 116. Also, position sensor 150 is coupled to compression ratio mechanism 170 for measuring compression ratio position.

Exhaust manifold 132 is coupled to an emission control device 146 and exhaust gas sensor 148. Emission control device 146 can be any type of three-way catalyst, such as a NOx adsorbent having various amounts of materials, such as precious metals (platinum, palladium, and rhodium) and/or barium and lanthanum. Exhaust gas sensor 148 can be a linear, or full range, air-fuel ratio sensor, such as a UEGO (Universal Exhaust Gas Oxygen Sensor), that produces a substantially linear output voltage versus oxygen concentration, or air-fuel ratio. Alternatively, it can be a switching type sensor, or HEGO (Heated Exhaust Gas Oxygen Sensor).

The reciprocating piston 112 is further coupled to a compression ratio mechanism 170 that is operated by an electronic engine controller 160 to vary the compression ratio of the engine. "Compression ratio" is defined as the ratio of the volume in the cylinder 111 above the piston 112 when the piston is at bottom-dead-center (BDC) to the volume in the cylinder above the piston 112 when the piston 112 is at top-dead-center (TDC). The compression ratio mechanism 170 is operated to effect a change in the engine's compression ratio in accordance with one or more parameters, such as engine load and speed, as shown by way of example in FIG. 11. Such parameters are measured by appropriate sensors, such as a speed (RPM) sensor 150, mass air flow (MAF) sensor 130, pedal position sensor 140, compression ratio sensor 160, manifold temperature sensor 162, and manifold pressure sensor (164), which are electronically coupled to the engine controller 160. The compression ratio mechanism 170 will be discussed in further detail below with reference to FIGS. 2A through 10.

Referring again to FIG. 1, the engine controller 160 includes a central processing unit (CPU) 1162 having corresponding input/output ports 169, read-only memory (ROM) 164 or any suitable electronic storage medium containing processor-executable instructions and calibration values, random-access memory (RAM) 166, and a data bus 168 of any suitable configuration. The controller 160 receives signals from a variety of sensors coupled to the engine 110 and/or the vehicle, and controls the operation of the fuel injector 115, which is positioned to inject fuel into a corresponding cylinder 111 in precise quantities as determined by the controller 160. The controller 160 similarly controls the operation of the spark plugs 113 in a known manner.

Figure 2A:
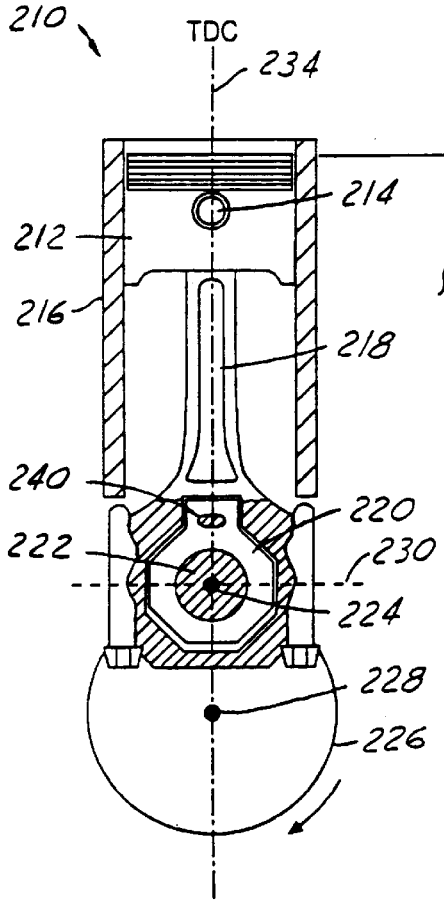
FIGS. 2A and 2B are diagrams showing low compression ratio operation of an internal combustion engine having a variable compression ratio apparatus in accordance with a preferred embodiment of the present invention.
Figure 2B:
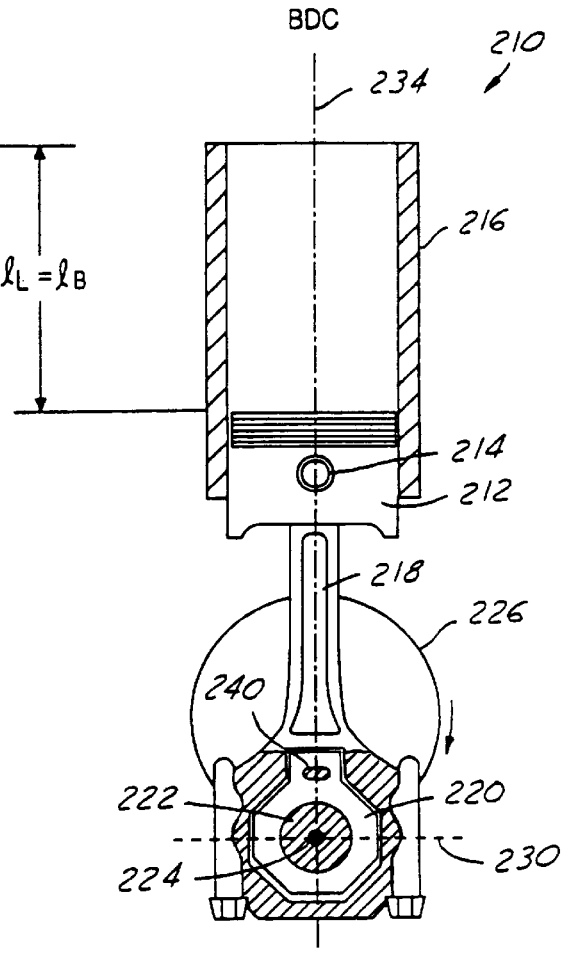
Figure 3A:
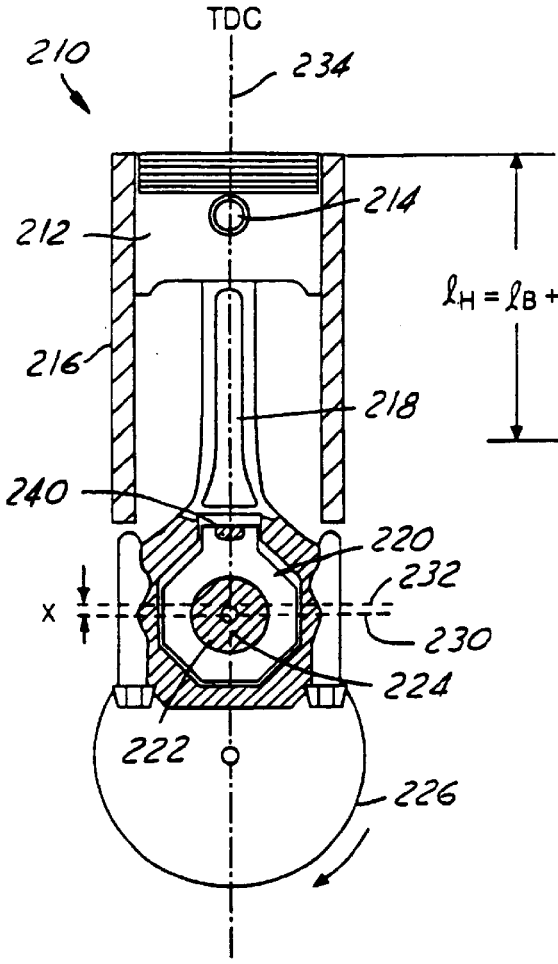
FIGS. 3A and 3B are diagrams showing high compression ratio operation of an internal combustion engine having a variable compression ratio apparatus in accordance with a preferred embodiment of the present invention.
Figure 3B:
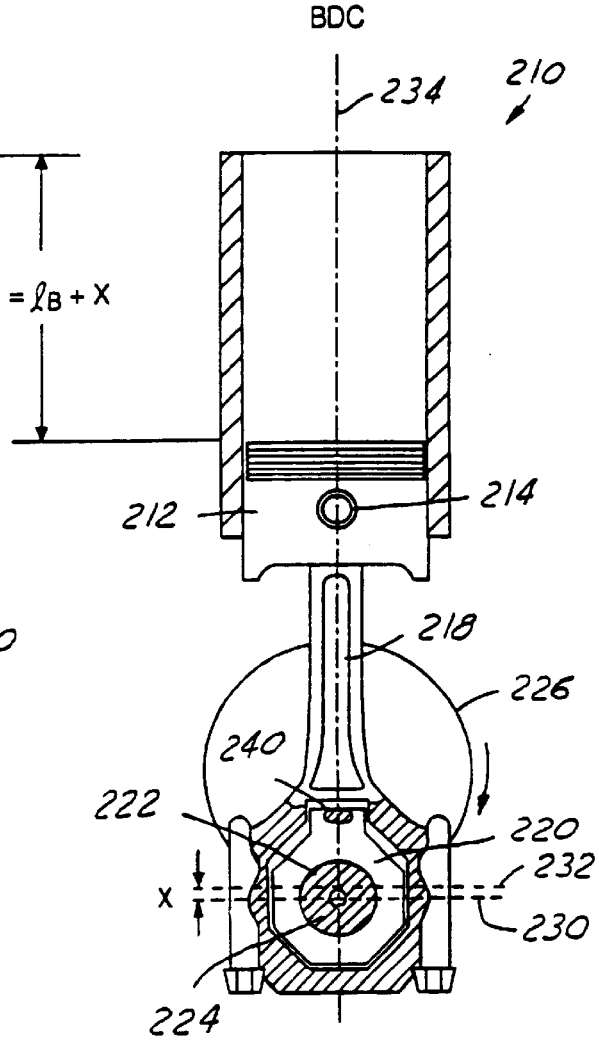

FIGS. 2A through 3B are diagrams illustrating the operation of an internal combustion engine having the variable compression ratio apparatus of FIGS. 2A of the present invention and 2B show the piston 212 top-dead-center (TDC) and bottom-dead-center (BDC) positions, respectively, corresponding to a "baseline" or "un-extended" position of a connecting rod 218. The compression mechanism as shown, for example, in the cut-away portions of FIGS. 2A an 2B, includes a bearing retainer 220 disposed between the connecting rod 218 and a crankpin 222, the crankpin having a centerline axis 224 extending in and out of the page and parallel to the axis of rotation 228 of a corresponding crankshaft 226. The bearing retainer 220 has a centerline axis 230 normal to the crankpin centerline axis 224, and, likewise, the connecting rod 218 has a centerline axis (shown as 232 in FIGS. 3A and 3B). When the connecting rod 218 is in the baseline position, as shown in FIGS. 2A and 2B, which herein corresponds to a low compression ratio mode of the internal combustion engine, the bearing retainer centerline axis 230 is coincident or substantially coincident with the connecting rod centerline axis 232. When the connecting rod is in an extended, high compression ratio mode position, as shown in FIGS. 3A and 3B, the bearing retainer centerline axis 230 is displaced with respect to centerline axis 232 of the connecting rod.

As such and further shown together FIGS. 4A through 5B, the bearing retainer 220 in accordance with the present invention includes an inner surface in communication with the crankpin 222 and an outer surface selectively slideable relative to the connecting rod 218. The outer surface of the bearing retainer is moveable with respect to the connecting rod 218 in a linear fashion along a longitudinal 234 extending between the first and second ends of the connecting rod 218. The connecting rod centerline axis is thus selectively displaced with respect to the bearing retainer centerline axis, thus causing a change in the effective length of the connecting rod and the compression ratio of the internal combustion engine. Therefore, as illustrated in FIGS. 2A through 3B, the effective length of the connecting rod/$_L$ during low compression ratio operation is equal to the baseline, un-extended length/$_B$ of the connecting rod, and the effective length of the connecting rod/$_H$ is equal to the extended length/$_B$+x of the connecting rod during high compression ratio operation.

FIGS. 4A through 5B show exploded and non-exploded perspective views of preferred embodiments of a connecting rod and compression ratio apparatus in accordance with the present invention. The preferred embodiments are, provided by way of example and are not intended to limit the scope of the invention claimed herein. Further detailed embodiments of the connecting rod and compression ratio apparatus can be found in co-pending U.S. application Ser. Nos. 09/691,668; 09/690,946; 09/691,669; and 09/682,465, all of which are hereby incorporated by reference in their entirety.

Figure 4A:
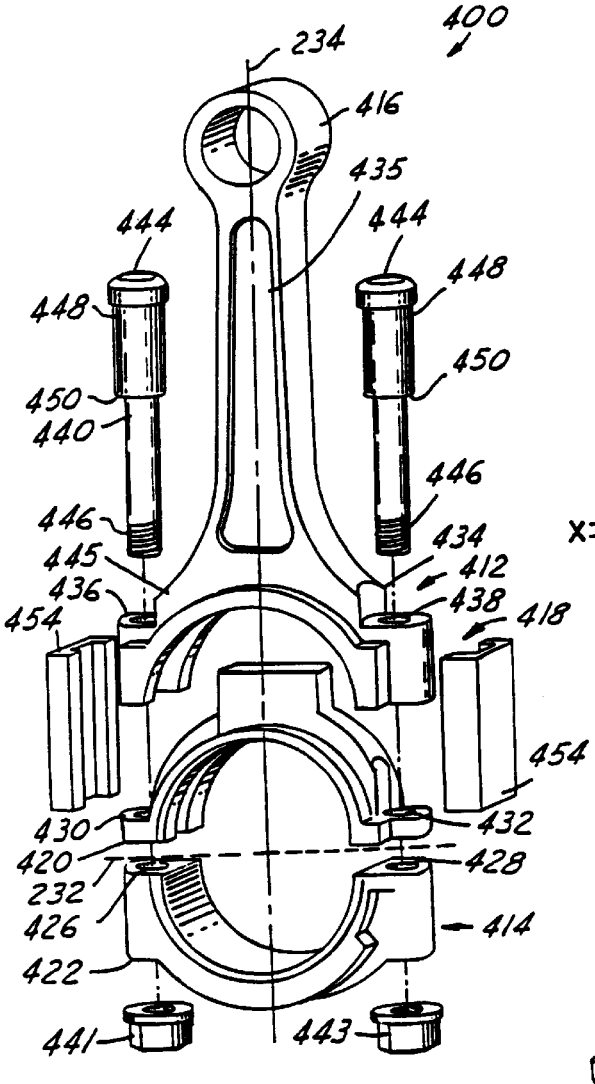
FIGS. 4A and 4B are exploded and non-exploded perspective views, respectively, of a connecting rod and variable compression ratio apparatus in accordance with the present invention.
Figure 4B:
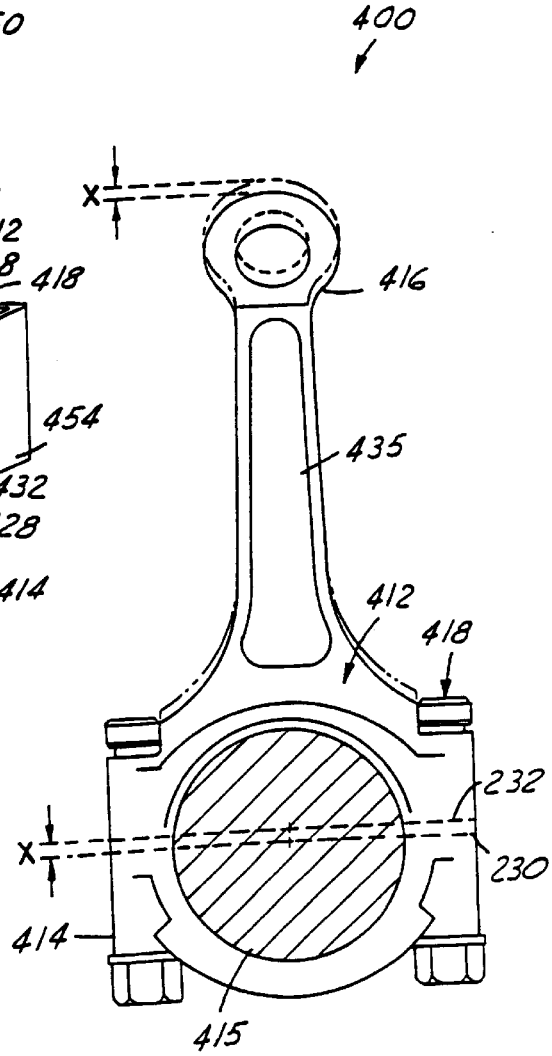

Referring to FIGS. 4A and 4B, exploded and non-exploded perspective views are provided, respectively, of a connecting rod and variable compression ratio apparatus in accordance with the present invention. The connecting rod 400 includes a first or so-called "large" end 412 for journaling on a crank pin 415 of a crankshaft, and a second so-called "small" end 416 for journaling on a central portion of a wrist pin (not shown) and for coupling the connecting rod 400 to a piston (not shown). A compression ratio apparatus 418 is embodied in the connecting rod at its large end for varying the effective length of the connecting rod as measured between the large and small ends 412 and 416.

In accordance with the present embodiment of FIGS. 4A and 4B, the large end 412 further includes an upper cap 420 and a lower cap 422 that are fastened together around the crank pin 415. Lower cap 22 includes parallel through-holes 426 and 428 at opposite ends of its semi-circumference. At opposite ends of its semi-circumference, upper cap 420 includes through-holes 430 and 432 that align with holes 426 and 427, respectively, when the two caps 420 and 430 are in communication with the crank pin.

Connecting rod 412 further includes a part 434 containing a connecting rod portion 435. One end of part 434 includes the small end 416, and the opposite end is coupled through the compression ratio mechanism 418 with large end 412. The coupling of the compression ratio mechanism and the large end 412 is preferably implemented using through-holes 436 and 438 that align with through-holes 430 and 432, respectively, fasteners 440 and 442, and nuts 441 and 443. Through-holes 436 and 438 are disposed mutually parallel, and are disposed in free ends of curved arms 445 that extend from connecting rod portion 435.

Each fastener 440 and 442 includes a head 444 disposed at a proximal end and a screw thread 446 disposed at a distal end. Intermediate proximal and distal ends, each fastener includes a circular cylindrical guide surface 448. The parts are assembled in the manner indicated by FIG. 4A with the respective fastener shanks passing though respective aligned through-holes 436 and 430, 438 and 432, and 426 and 428; and threading into respective nuts 441 and 443. The diameters of through-holes 436 and 438 are larger than those of through-holes 430 and 432 to allow shoulders 450 at the ends of guides 448 to bear against the margins of through-holes 430 and 432. As the fasteners and nuts are tightened, such as by turning with a suitable tightening tool, the two caps 420 and 422 are thereby forced together at their ends, crushing the crank pin bearing in the process and thereby forming a bearing retainer structure around the crank pin.

The axial length of each guide surface 448, as measured between head 444 and shoulder 450, is slightly greater than the axial length of each through-hole 436 and 438, and the diameters of the latter are slightly larger than those of the former to provide sliding clearance. In this way, it becomes possible for the rod part 434 to slide axially, i.e., the outer surface of the combined 420/430 assembly is axially movable relative to the connecting rod, over a short range of motion relative to the large end 412 along a longitudinal axis 234 extending between the large and small ends of the connecting rod. The range of motion is indicated in FIG. 4B by the displacement x of a connecting rod centerline 232 with respect to a centerline 230 of the assembled caps 420 and 430. The displacement x of the two centerline axes thus translates into a change x in length of the connecting rod assembly 400. When arms 445 abut part 420 around the margins of through-holes 30 and 32, the connecting rod assembly 400 has a minimum or "baseline" length corresponding to a low compression ratio mode of operation for the internal combustion engine. When arms 445 abut heads 444, the connecting rod assembly 400 has a maximum or extended length corresponding to a high compression ratio operation of the internal combustion engine.

As further shown in FIGS. 4A and 4B, channels 454 may be assembled at the sides of the connecting rod assembly 400 to provide additional bearing support for the axial sliding motion of the connecting rod. Mechanism 418 may include passive and/or active elements for accomplishing overall length change, and resulting compression ratio change.

Figure 5A:
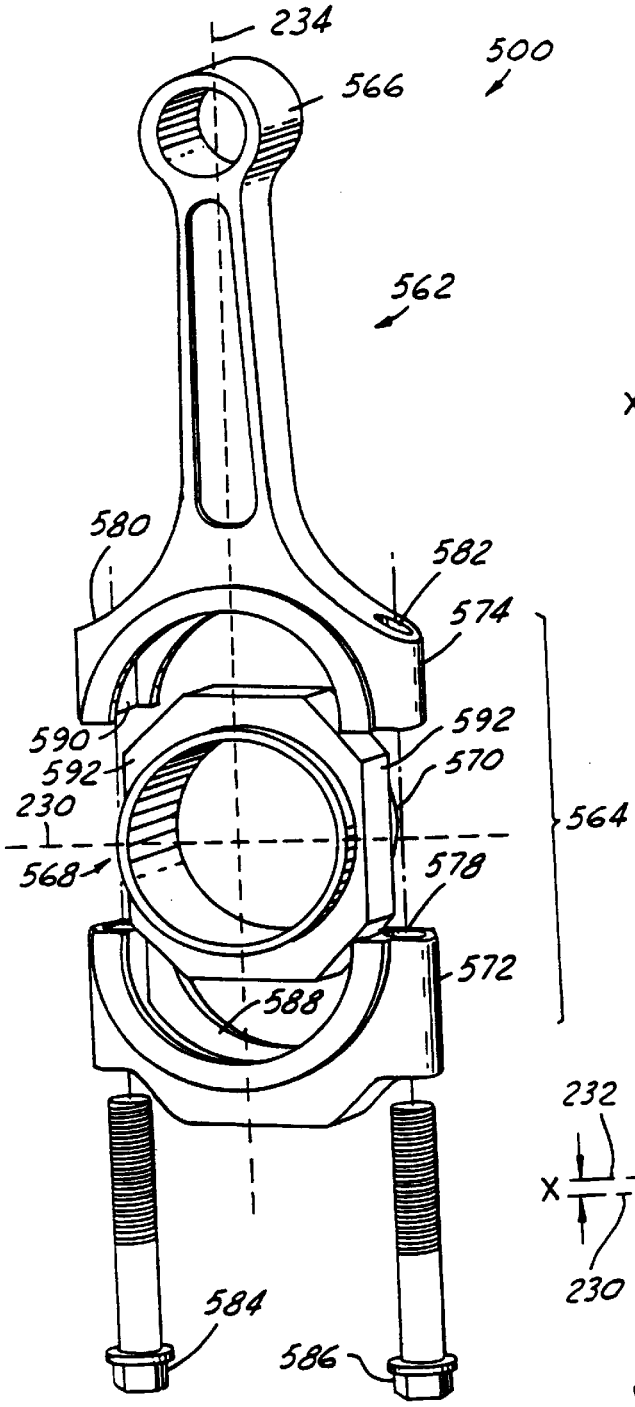
FIGS. 5A and 5B are exploded and non-exploded perspective views, respectively, of a connecting rod and variable compression ratio apparatus in accordance with another preferred embodiment of the present invention.
Figure 5B:
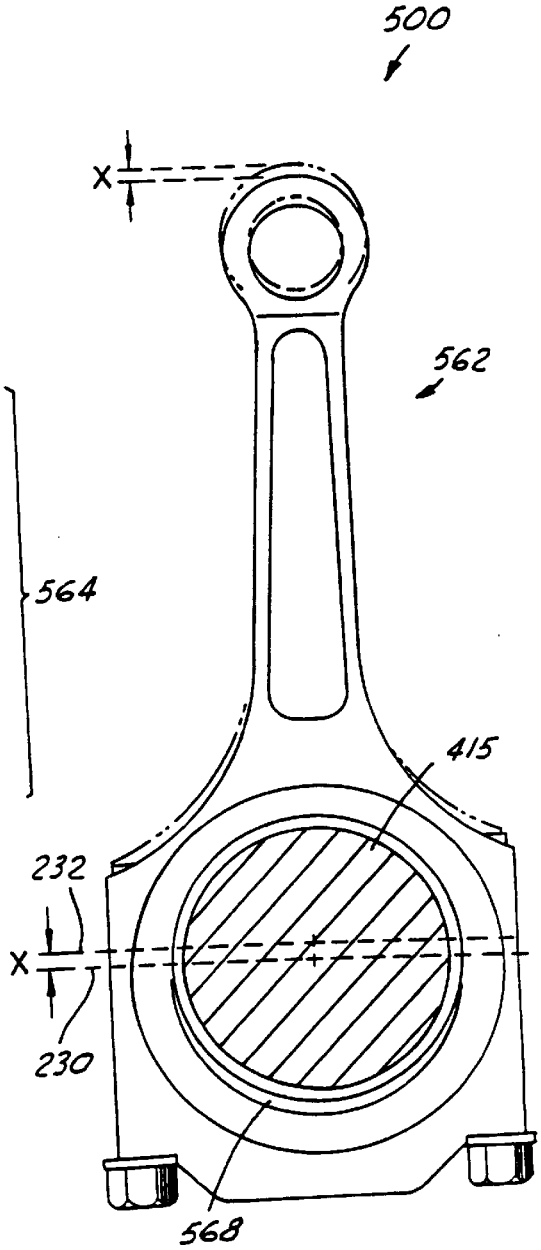

FIGS. 5A and 5B are exploded and non-exploded perspective views, respectively, of another embodiment of a connecting rod and compression ratio mechanism in accordance with the present invention. As shown in FIGS. 5A and 5B, a connecting rod 500 comprises a large end 564 for journaling on a crank pin 415 of a crankshaft (not shown) and a small end 566 for journaling on a central portion of a wrist pin (not shown) for coupling the connecting rod 500 to a piston (not shown). The compression ratio mechanism 568 is embodied in this case entirely within the large end 564 of the connecting rod 500 to provide for variation in the overall length between the large and small ends of the connecting rod.

Mechanism 568 in accordance with the present invention is provided by a single-piece bearing retainer 570, which is captured between a cap 572 and one end of a rod part 574. Opposite ends of the semi-circumference of cap 572 contain holes 576 and 578 that align with threaded holes 580 and 582 in rod part 574. Fasteners 584 and 586 fasten the cap to the rod part. The cap and rod part have channels 588 and 590 that fit to respective portions of a flange 592 of bearing retainer 570. The channel and flange depths are chosen to allow the assembled cap and rod part to move axially a short distance on the bearing retainer, thereby changing the overall length, as marked by x in FIG. 5B. Mechanism 568 may comprise passive and/or active elements for accomplishing overall length change and corresponding compression ratio change. The channels form the groove, and the flange the tongue, of a tongue-and groove type joint providing for sliding motion that adjusts the length of the connecting rod assembly.

Figure 6A:
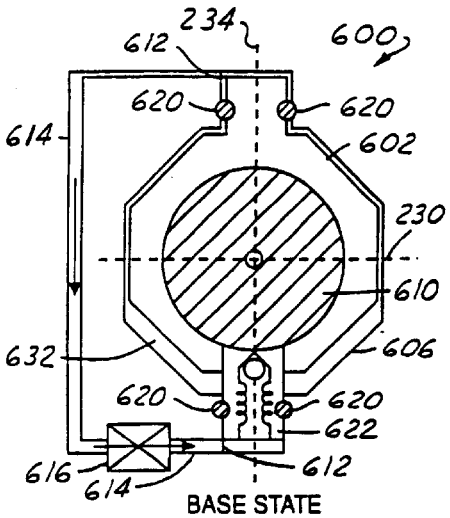
FIGS. 6A and 6B are diagrams showing the operation of an exemplary variable compression ratio apparatus in accordance with a preferred embodiment of the present invention.
Figure 6B:
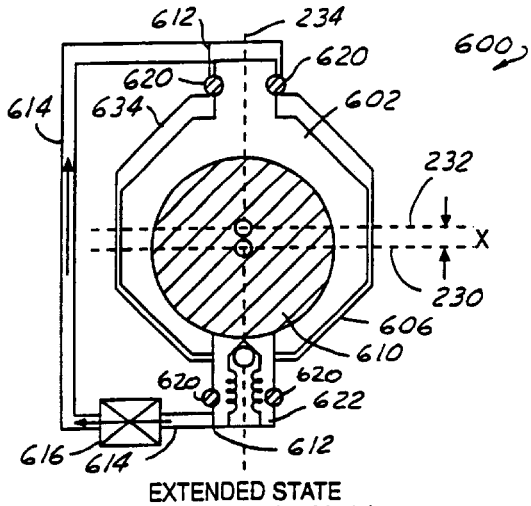

FIGS. 6A and 6B are schematic diagrams showing the operation of an exemplary compression ratio mechanism 600 in accordance with a preferred embodiment of the present invention. In FIGS. and 6B, the compression ratio mechanism 600 includes a unitary bearing retainer 602 having post portions 621 and 622 disposed on opposite ends of the main bearing retainer along the longitudinal axis 234 of the connecting rod. Note, only a cut-out, inner profile 606 of the connecting rod is shown in FIGS. 6A and 6B. When the compression ratio mechanism of the present invention is assembled within the inner profile of the connecting rod, the mechanism is actuated from a low compression ratio position as shown in FIG. 6A to a high compression ratio position as shown in FIG. 6B, and vice-versa, by actuating the bearing retainer via a hydraulic or electromechanical system coupled to and/or within the connecting rod. A hydraulic system, having openings 612 and conduits 614, is provided for enabling the flow of oil or other suitable fluid to and from each of the post regions so as to move the entire bearing retainer from one position to another. A check valve 616 is also provided for controlling the flow of oil used to position the connecting rod relative to the bearing retainer.

In order for the connecting rod to move from an extended state to the baseline state, the rod must be in compression, e.g., during the combustion stroke of a four-stroke internal combustion engine, and the check valve 620 must be positioned so as to allow the flow of oil into the lower reservoir 632 formed between the inside of the connecting rod and the bearing retainer. The check valve allows oil to move from the upper reservoir 634 to the lower reservoir 632. In this manner, the connecting rod is locked in the baseline position until the check valve is moved.

In order for the VCR to move back to the extended position, the rod must be in tension, e.g., during the intake stroke of a four-stroke internal combustion engine, and the check valve 620 must be positioned so as to allow the flow of oil from the lower reservoir 632 to the upper reservoir 634. In this manner, the connecting rod remains locked in the extended, high compression ratio position.

In the present embodiment, a positive oil pressure, combined with inertial forces on the connecting rod, is used to extend or retract the connecting rod as required to yield the desired compression ratio. Further, the positive oil pressure is used to maintain or "lock" the connecting rod in the desired position. FIGS. 7 through 10, discussed below, show alternative embodiments of the compression ratio mechanism having one or more hydraulically or electromechanically actuated locking mechanisms for maintaining the effective length of the connecting rod as required.

Figure 7:
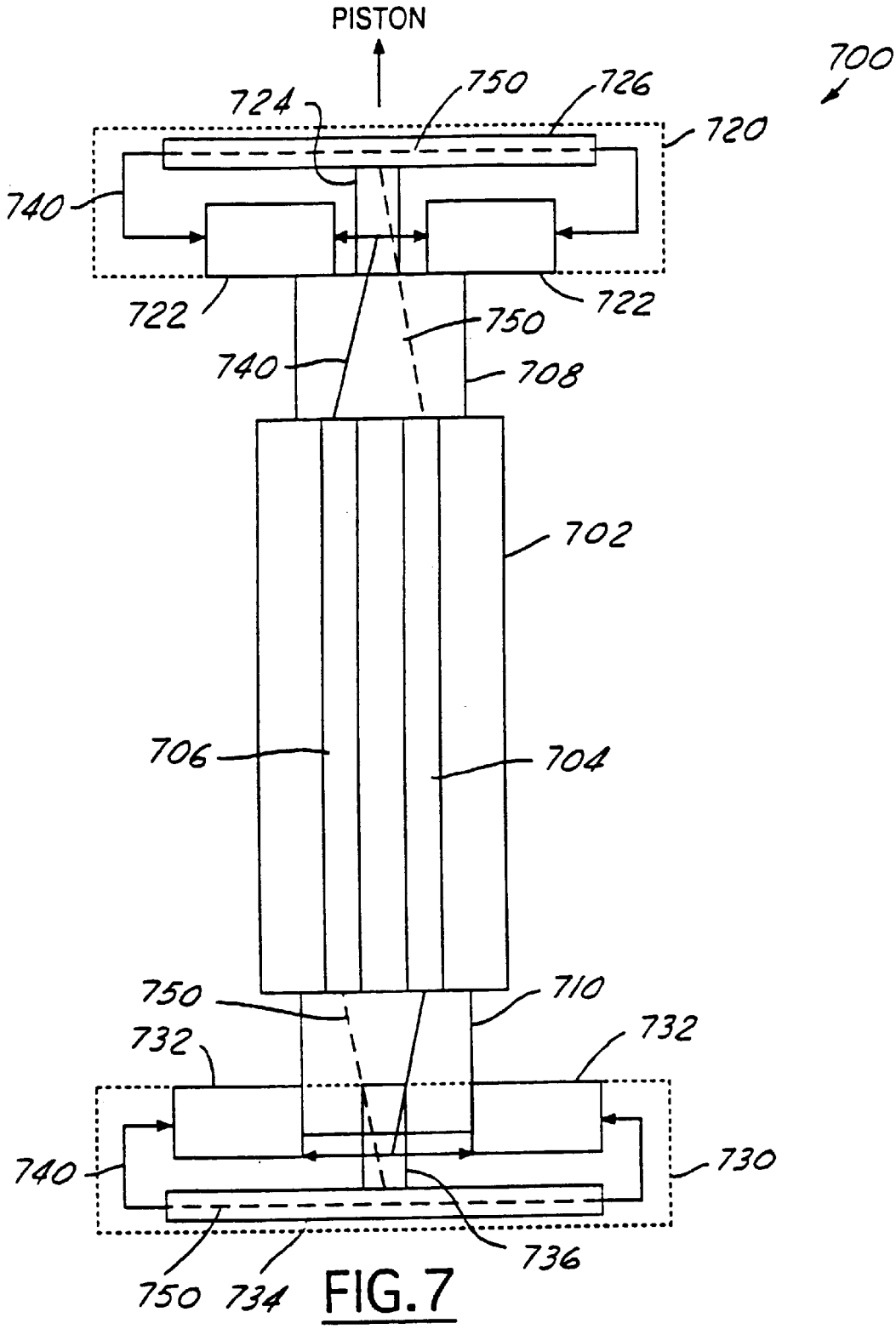
FIG. 7 is a diagram showing the operation of an exemplary variable compression ratio apparatus having two locking mechanisms in accordance with a preferred embodiment of the present.

FIG. 7 is a diagram showing the operation of an exemplary compression ratio apparatus having two locking mechanisms 722 and 732 in accordance with a preferred embodiment of the present. The mechanism further includes a bearing retainer having a main body portion 702 in contact with a corresponding crankpin, an upper post portion 708, a lower post portion 710, and oil conduits 704 and 706 for providing passageways for a high-pressure oil line 740 and a low pressure oil line 750. The elements or portions thereof, shown within boxes 720 and 730, are preferably housed within the large end of the connecting rod adjacent to the corresponding post portions 708 and 710 of the bearing retainer.

The locking mechanisms shown in FIG. 7 are held in their current positions using the low "lubrication" oil pressure line 750 and transitioned to the next position using the high-pressure oil line 740. The high-pressure line 740, which is represented in FIG. 7 as a solid line, is used for transitioning the connecting rod to the next position. This is accomplished using high-pressure pulses on line 740 that cause the elements of the locking mechanisms 722 and 732 either to compress or move apart so as to allow compression or tension forces on the connecting rod to transition the rod to a high compression ratio mode position or low compression ratio mode position. The low oil pressure line 750, in contrast, is used to maintain the locking pins 722 and 732 in their positions after corresponding high-pressure pulses have been provided to displace the centerline axis of the connecting rod. Preferably, a single high-pressure pulse on high-pressure line 740 causes the lock pin already in the "locked" position, for example mechanism 722 shown in FIG. 7, to expand and thus unlock while at time causing the opposing lock mechanism 732 to compress and remain in a locked position after the connecting rod shifts in the direction away from the piston. As shown in FIG. 7, the operation of the compression ratio apparatus thus corresponds to a transition from high compression ratio mode to low compression ratio mode.

Note, as with all of the preferred embodiments of the present invention, it is understood that the compression ratio apparatus of the present invention can be adapted accordingly to transition between more than two compression ratio states. For example, the compression ratio apparatus can be designed accordingly to transition between three or more compression ratio states, i.e., high, medium, and low compression ratio states.

Note, also, that the control methods of the present invention can be used with any of the above compression ratio mechanisms, or any other mechanism, which varies the compression ratio of the engine. Further, the methods of the present invention are applicable to mechanisms that provide a continuously variable range of compression ratios. While certain combination of the methods described herein and different mechanical embodiments may provide synergistic results, the inventors herein have contemplated using the control methods with any mechanism that can change the engine compression ratio.

Figure 8:
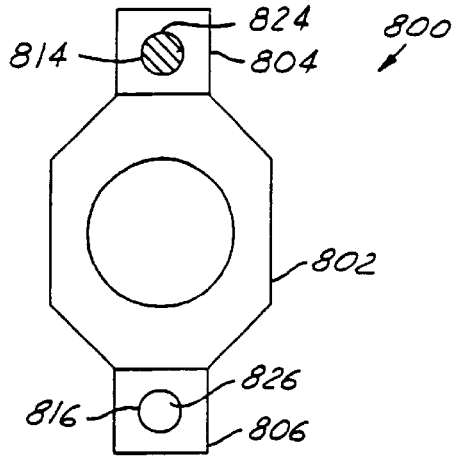
FIG. 8 is a diagram of an exemplary variable compression ratio apparatus having two opposing locking mechanisms and corresponding through-holes.
Figure 9A:
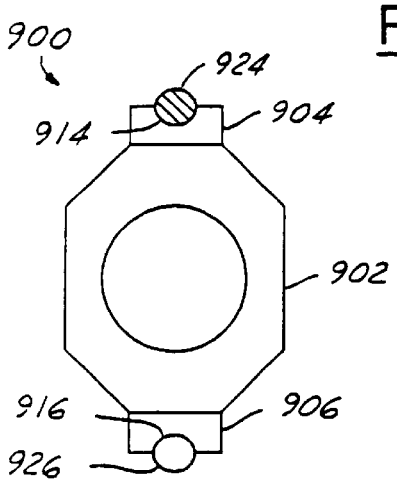
FIGS. 9A and 9B are diagrams of exemplary variable compression ratio apparatuses having two opposing locking mechanisms and corresponding channels.
Figure 9B:
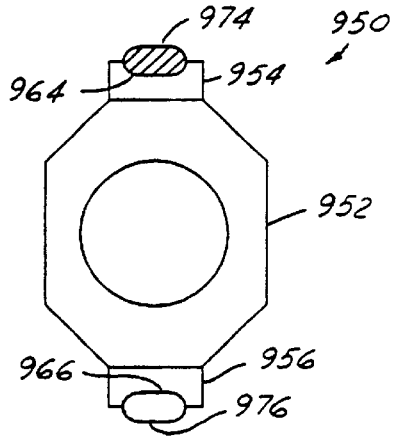
Figure 10:
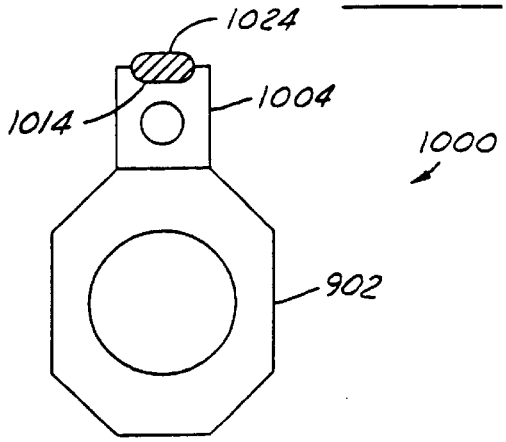
FIG. 10 is a diagram of an exemplary variable compression apparatus having a single locking mechanism and a corresponding channel.

FIGS. 8 through 10 show alternative embodiments of the locking mechanisms for the compression ratio apparatus of the present invention. FIG. 8 is a diagram of an exemplary variable compression apparatus having two opposing locking mechanisms 824 and 826 and corresponding through-holes 814 and 816 formed through post portions 804 and 806. Lock mechanism 814, shown in FIG. 8 as a shaded region, is shown to be in a locked position. Preferably, both mechanisms are cylindrically shaped pins suitably designed to withstand the inertial forces exerted via the connecting rod during operation of the engine.

FIG. 9A shows a similar embodiment, as shown in FIG. 8, except that locking mechanisms 924 and 926 are arranged and constructed to cooperate with corresponding channels 914 and 916 formed on the upper and lower sides of the post portions 904 and 906, respectively. An additional embodiment is also shown in FIG. 9B, except that the locking mechanisms are flattened cylindrical pins 974 and 976 having correspondingly shaped channels 964 and 966 formed on post portions 954 and 956. FIG. 10 shows an embodiment similar to the embodiment of FIG. 9B, except that only one post 1004 and corresponding locking mechanism/channel 1024/1014 are provided.

Figure 11:
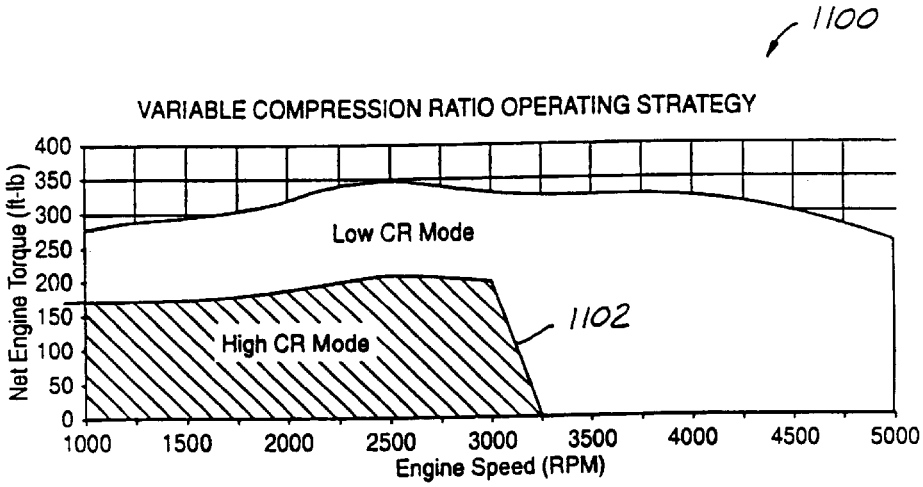
FIG. 11 is a plot showing an exemplary variable compression ratio operating strategy in accordance to a preferred embodiment of the present invention.

FIG. 11 is a plot showing an exemplary compression ratio map 1100 for use with the various compression ratio apparatuses described above. The map 100 shows the operating strategy for a variable compression ratio internal combustion engine, and is implemented in accordance with a preferred embodiment of the present invention by the electronic engine controller of FIG. 1. The mapping, which is embodied in computer readable program code and corresponding memory means, is used to operate an internal combustion engine in accordance with high and low compression ratio modes 1102 and 1104, respectively, depending on the detected operating speed and load of the internal combustion engine. The mapping determines when the compression modes are to be switched. There are various other ways in which the compression ratio may be scheduled such as, for example, based on engine coolant temperature, time since engine start, pedal position, desired engine torque, or various other parameters, or as described later herein.

Figure 12:
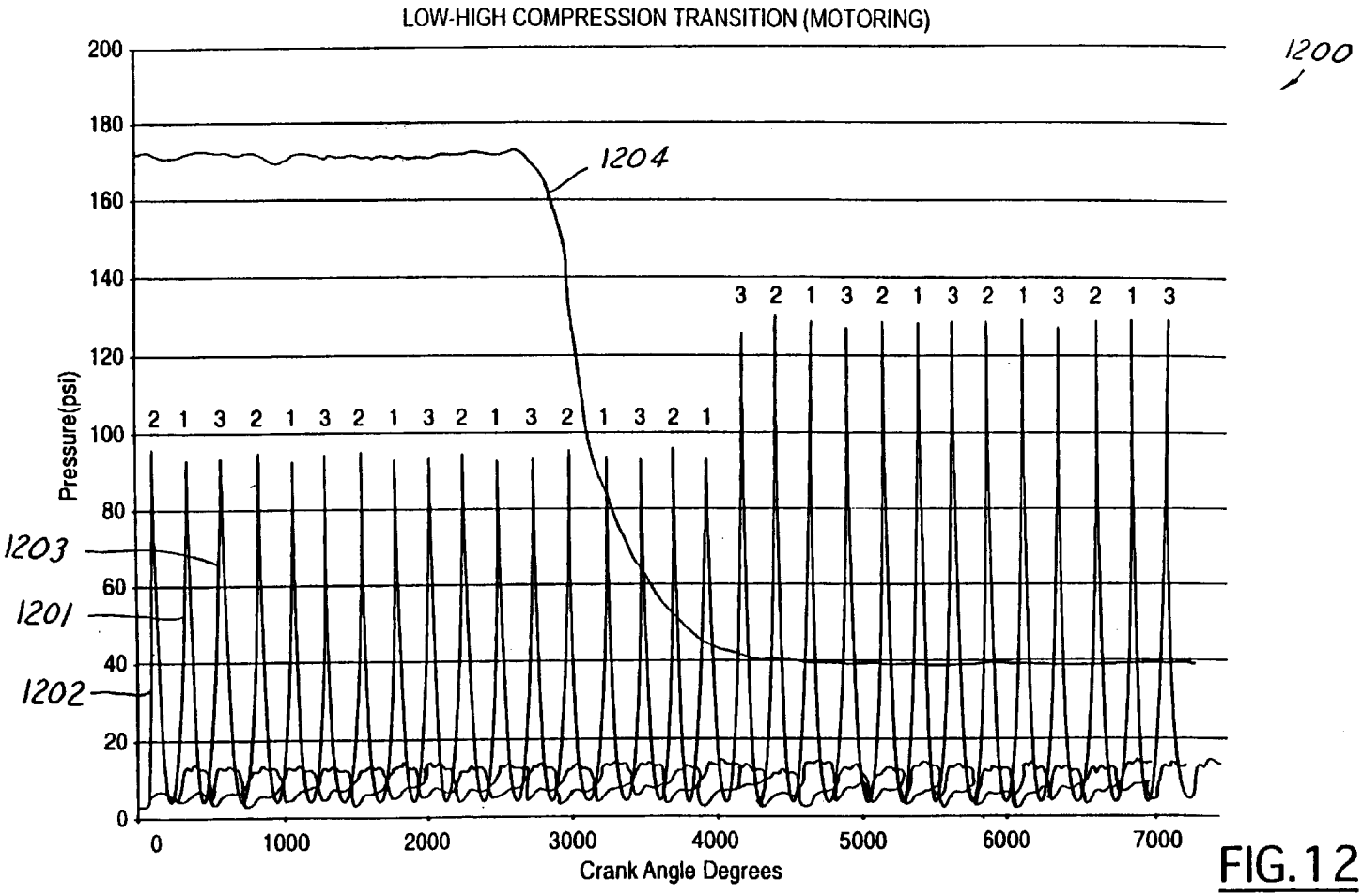
FIGS. 12 and 13 are plots of cylinder and oil pressure versus crank angle degrees during the motoring of an exemplary variable compression ratio internal combustion engine arranged and constructed in accordance with the present invention.
Figure 13:
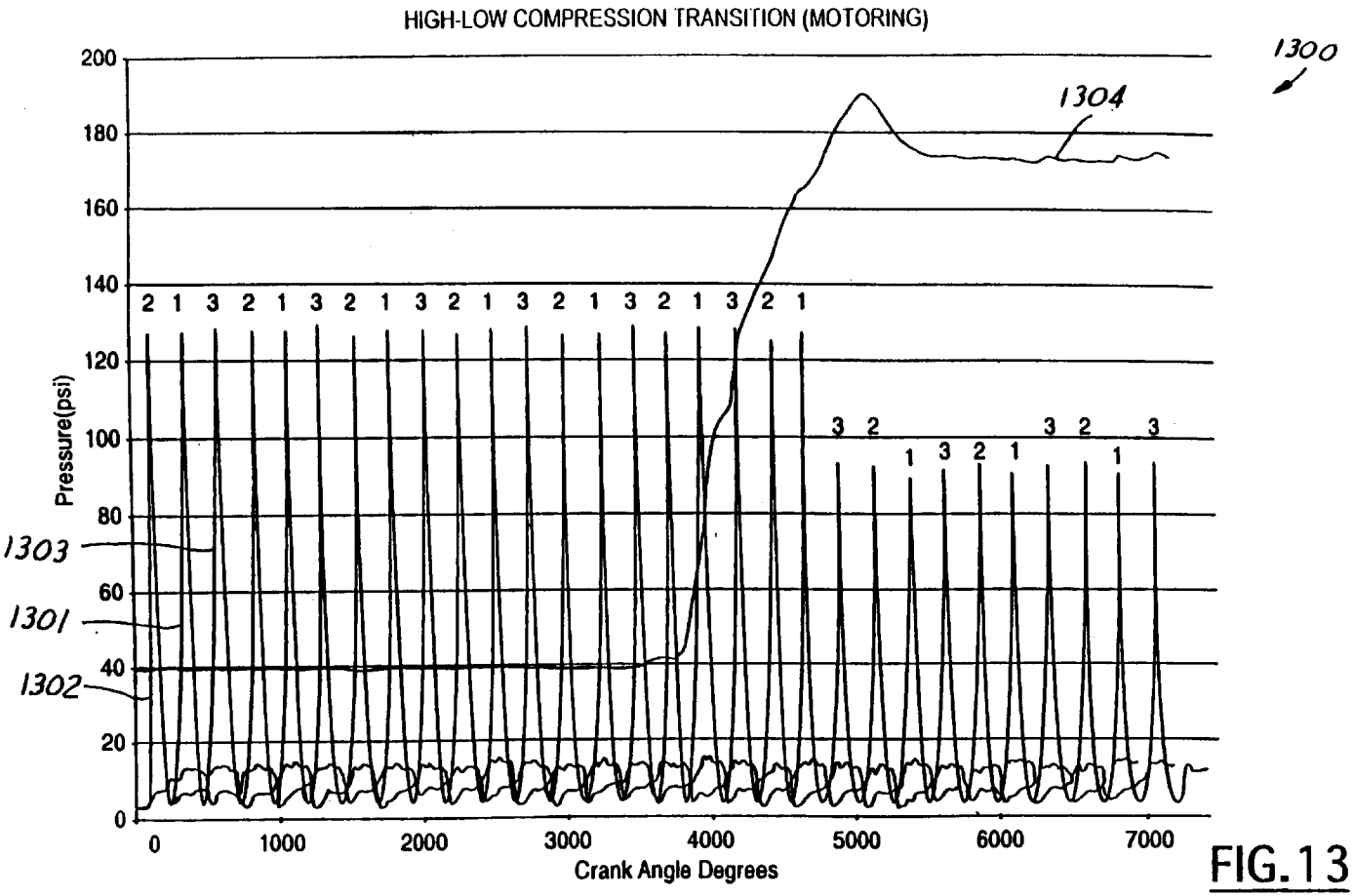
Figure 14:
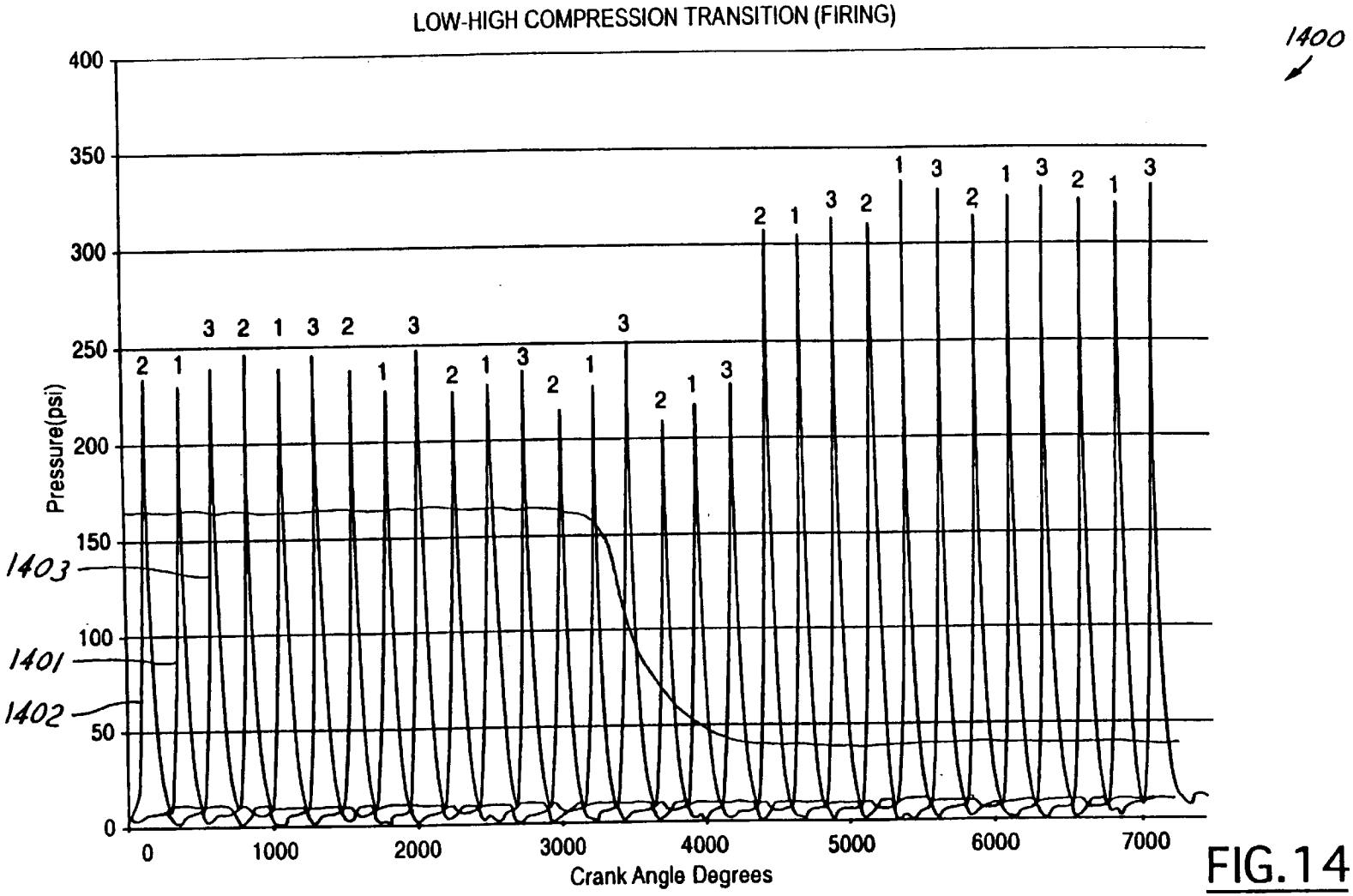
FIGS. 14 and 15 are plots of cylinder and oil pressure versus crank angle degrees during the firing of an exemplary variable compression ratio internal combustion engine arranged and constructed in accordance with the present invention.
Figure 15:
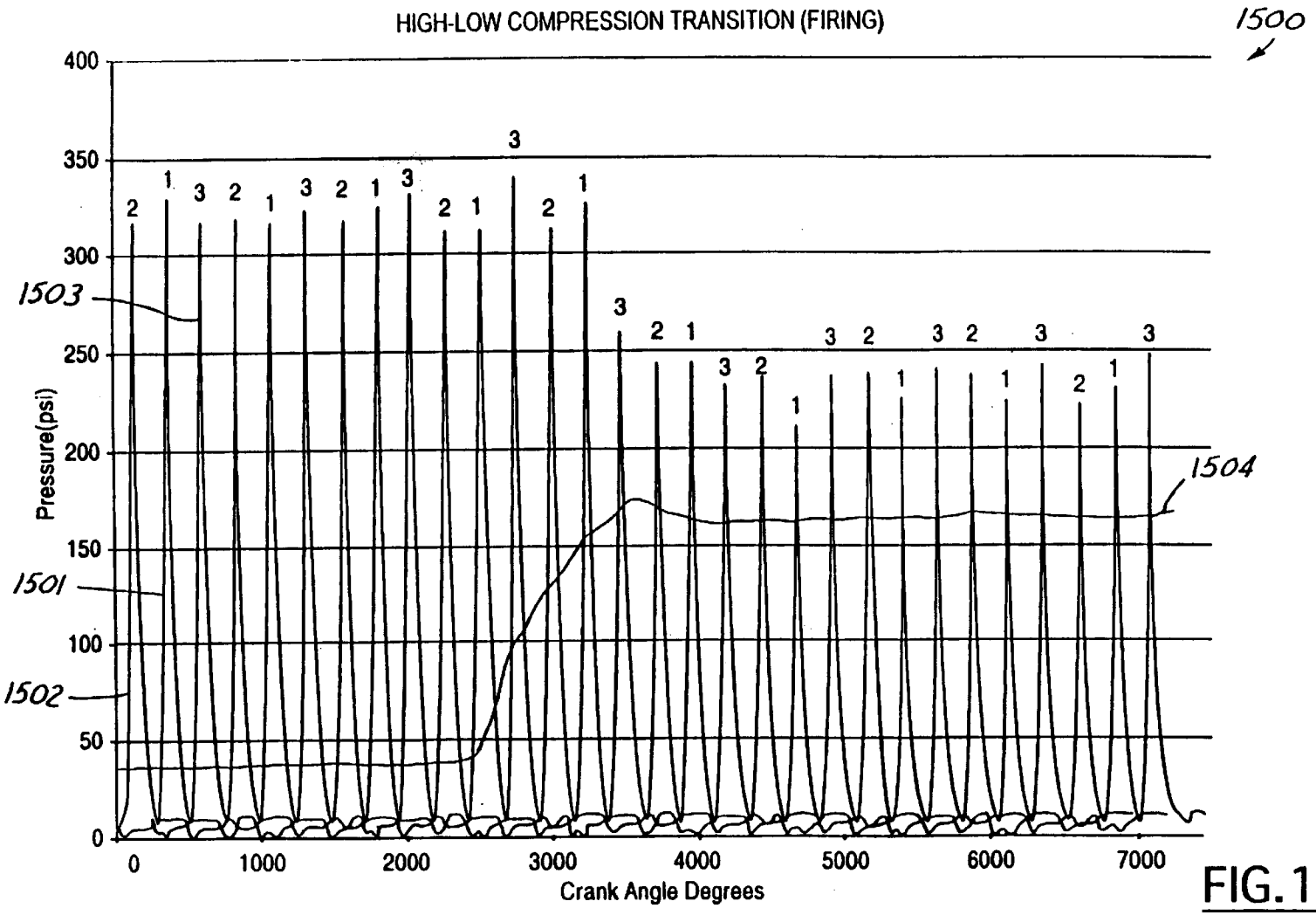

FIGS. 12 through 15 are plots of cylinder and oil pressure versus crank angle degrees for a three-cylinder, four-stroke variable compression ratio gasoline internal combustion engine. FIGS. 12 and 13 correspond to low-to-high and high-to-low compression mode transitions, respectively, and show plots of cylinder and oil pressure during motoring. FIGS. 14 and 15 also correspond to low-to-high and high-to-low compression mode transitions, respectively, and show plots of cylinder and oil pressure during firing. All of FIGS. 12 through 15 show pressure plots 1201–1203, 1301–1303, 1401–1403 and 1501–1503 for each of the cylinders (plots also labeled "1", "2" and "3") and "galley" oil pressure plots 1204, 1304, 1404 and 1504. Operating conditions include a nominal engine speed of 1500 rpm (1500 rpm, 2.62 bar brake mean effective pressure (BMEP) for firing cylinders) with an oil temperature of approximately 120 degrees F. and an engine coolant temperature of approximately 150 degrees F.

The plots 1200 through 1500 shown in FIGS. 12 through 15 correspond to an engine having compression ratio apparatuses requiring a relatively high oil pressure, nominally greater than 100 psi, for maintaining the connecting rods in a low compression ratio operating mode, and a relatively low oil pressure, nominally less than 100 psi, for maintaining the connecting rods in a high compression ratio operating mode. The actual values of the oil pressure levels and relation to compression ratio modes however is not intended to limit the scope of the present invention. As indicated by the plots, once the galley oil pressure reaches a threshold level, the connecting rods transition within a single engine cycle to the commanded position. The transitions in FIGS. 12 and 14 result in high compression mode operation, and the transitions in FIGS. 13 and 15 result in low compression mode operation.

Accordingly, embodiments of a compression ratio apparatus have been described having a bearing retainer in cooperation with a connecting rod wherein the centerline axis of the connecting rod is displaced quickly and reliably with respect to the centerline axis of the bearing retainer to effect a change in the length of the connecting rod, thereby selectively causing a change in the compression ratio of the internal combustion engine. The transition from one compression ratio mode to another is accomplished in a linear fashion without requiring the rotation of an eccentric ring member as shown by the prior art. The compression ratio can be actuated in accordance with any suitable control strategy using a suitable hydraulic or electromechanical system. In a preferred embodiment, the engine's oil system is used to actuate the mechanism to produce a selected compression ratio for the internal combustion engine.

Figure 16:
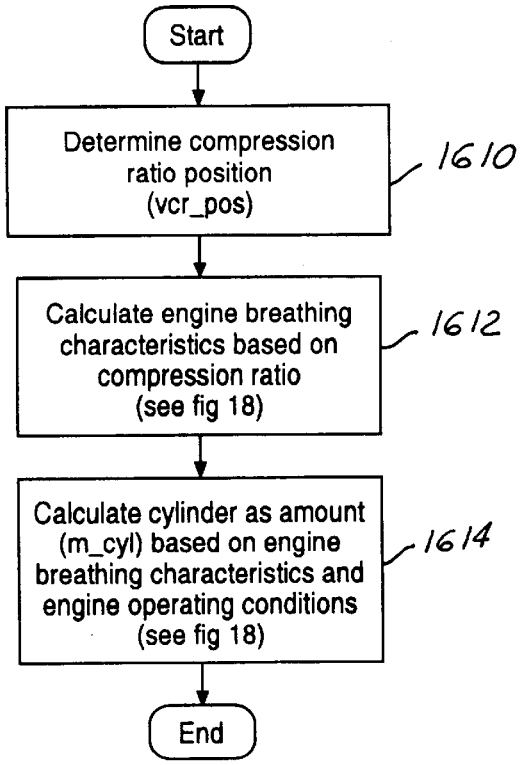
FIGS. 16–18 show flow charts illustrating various control methods.
Figure 17:
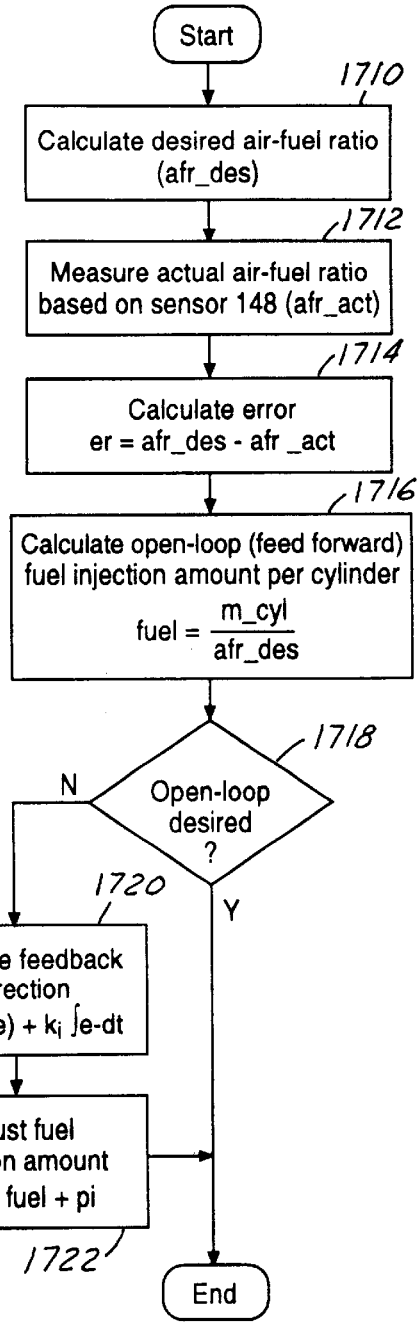
Figure 18:
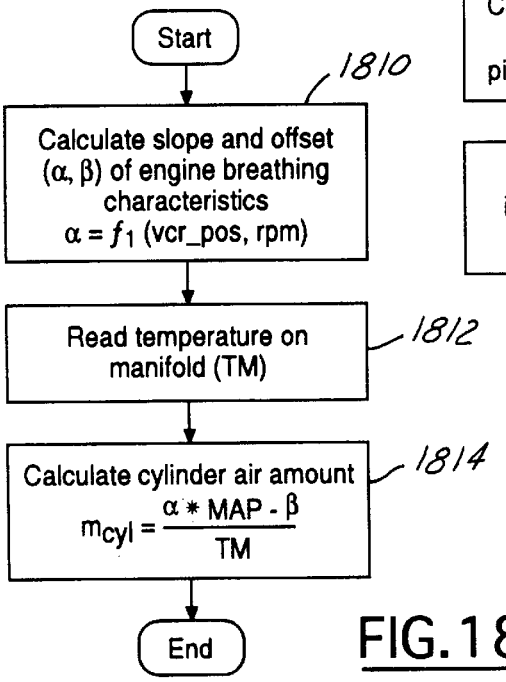

FIGS. 16–18 describe various control methods, which can be used with, or independently, of the control methods described above.

Referring now to FIG. 16, a method is described for calculating cylinder air amount of the engine cylinders. First, in step 1610, the compression ratio position is determined. In other words, a determination is made as to what position the variable compression ratio mechanism is in. Alternatively, a determination as to what the actual compression ratio of the engine is can be made. Alternatively, an estimate of compression ratio, or position of a variable compression ratio mechanism, could be determined based on various engine operating parameters such as, for example, hydraulic pressure; engine torque; hydraulic command signals; or various other parameters. In other words, compression ratio could be inferred based on a commanded compression ratio.

Next, in step 1612, engine breathing characteristics are calculated based on compression ratio and other operating characteristics, as described later herein with particular reference to FIG. 18. Then, in step 1614, a cylinder air amount is calculated based on the engine breathing characteristics and other engine operating conditions as described later herein with particular reference to FIG. 18.

Referring now to FIG. 17, an air/fuel ratio control method is described. First, in step 1710, a desired air/fuel ratio (afr_des) is calculated. For example, the desired air/fuel ratio can be calculated based on various engine operating conditions such as, for example, engine operating temperature; constant engine start; or other operating parameters. Further, the desired air/fuel ratio can be during certain conditions such as during catalyst protection where the air/fuel ratio can be made rich of stoichiometry. In some operating conditions, the desired air/fuel ratio is set to oscillate around the stoichiometric air/fuel ratio.

Next, in step 1712, the actual air/fuel ratio is measured based on sensor 148. In particular, the air/fuel ratio is inferred based on a lack of or excess unburnt oxygen in the exhaust gas.

Next, in step 1714, an error term is calculated based on the difference between the desired air/fuel ratio and the measured air/fuel ratio. Then, in step 1716, an open loop, or feed forward, fuel injection amount per cylinder is calculated based on the ratio of the ratio of the estimated cylinder charge and the desired air/fuel ratio. The estimated cylinder air amount is determined later herein with particular reference to FIG. 18. Then, in step 1718, a determination is made as to whether open loop air/fuel ratio control is desired. For example, open loop air/fuel ratio may be desired under warm-up where exhaust gas sensor 148 does not provide an accurate indication. Also, if sensor 148 is a switching EGO sensor, open loop air/fuel ratio may be utilized when operating away from stoichiometry. When the answer to step 1718 is no, the routine continues to step 1720. In step 1720, a feedback correction (pi) is calculated using a proportional and integral controller. In particular, proportional gain Kp and integral gain Ki are utilized. Those skilled in the art, in view of this disclosure, will recognize that various other feedback control techniques may be used such as nonlinear control gains, state/space control methods, or any other methods known to those skilled in the art in the use of air/fuel ratio control. Also, note various reasons for operating in open-loop air-fuel ratio control. Open loop air-fuel ratio control may be utilized during enrichment for catalyst temperature protection. In this mode, the engine is operated rich. If a HEGO sensor is used, it simply indicates rich without giving the degree of richness. Thus, the controller operates in an open loop mode.

Continuing with FIG. 17, in step 1722, the fuel injection amount is adjusted based on the feedback correction value. In this way, the fuel injection amount is adjusted with both feedback and feed-forward control.

Referring now to FIG. 1810, the routine calculates the engine breathing characteristics. In particular, a slope and offset term ($\alpha$, $\beta$) are calculated based on the engine compression ratio and engine speed. The slope and offset values represent engine breathing characteristics that relate manifold pressure, cylinder air amount, and temperature together.

Note that various other engine maps could be used. For example, a volumetric efficiency map could be used and a volumetric efficiency calculated based on the variable compression ratio of the engine and other engine operating parameters. If a volumetric efficiency is calculated, the cylinder air amount can determined based on the volumetric efficiency and manifold pressure, along with several other operating parameters.

Also, various engine operating conditions can be used to determine or adjust the fuel injection amount. For example, MAP, MAF, engine temperature, and manifold temperature can be used.

Next, in step 1812, manifold temperature is determined from the manifold temperature sensor. However, if the manifold temperature sensor is not provided, a manifold temperature estimate can be determined as is known to those skilled in the art in view of this disclosure, based on various other engine operating conditions. For example, one can estimate manifold temperature based on coolant temperature and external air temperature.

Then, in step 1814, cylinder air amount is calculated based on manifold pressure, the slope and offset, and manifold temperature.

In this way, it is possible to calculate an accurate value of the cylinder air amount using a manifold pressure sensor, even when compression ratio of the engine changes. Further, it is possible to accurately control air/fuel ratio during transients and changes of the engine compression ratio even if feedback from an exhaust gas sensor is not available.

Further, various alterations and modifications to the above-described methods can be made. For example, it is possible to include the engine fueling dynamics in the calculation of the fuel injection amount. Also, various engine operating parameters can be used to calculate the cylinder air amount such as the mass airflow sensor, throttle position, or the exhaust gas recirculation amount, if present.

Figure 19:
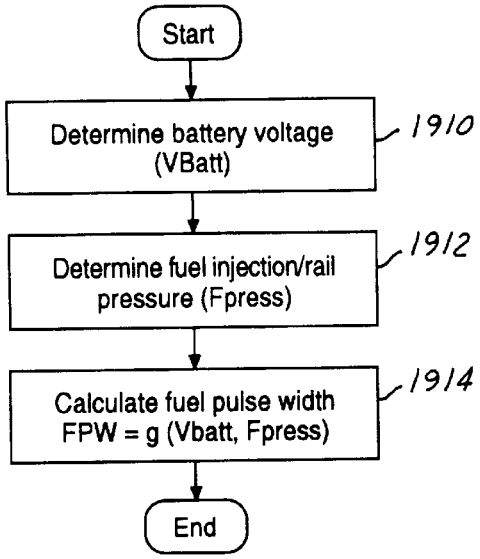
FIG. 19 shows a flow chart illustrating a routine for calculating a fuel pulse width (FPW).

Referring now to FIG. 19, a routine is described for calculating the fuel pulse width (FPW) sent to fuel injector 115. First, in step 1910, the routine determines the battery voltage. Then, in step 1912, the routine determines the fuel injection or fuel rail pressure (Fpress). Each of these parameters, as well as various other parameters, affect the amount of fuel injected for a given fuel pulse width. Then, in step 1914, the fuel pulse width is calculated based on the determined battery voltage and fuel pressure.

Figure 20:
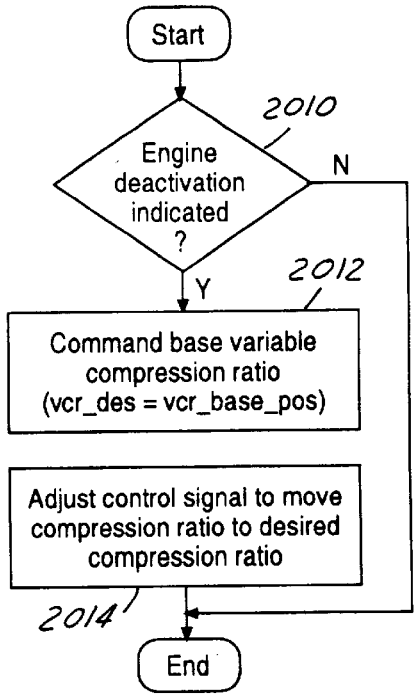
FIG. 20 shows a flow chart illustrating a control method for placing the compression ratio with a variable compression ratio engine to a base compression ratio in response to an indication of engine deactivation or engine shutdown.

Referring now to FIG. 20, a control method is described for placing the compression ratio with a variable compression ratio engine to a base compression ratio in response to an indication of engine deactivation or engine shutdown. First, in step 210, a determination is made as to whether engine deactivation has been indicated. There are various ways to indicate engine deactivation. For example, it can be indicated based on an operating parameter. The operating parameter can be, for example, an ignition key position. Thus, by determining whether the ignition key is engaged or disengaged, a determination of engine deactivation can be provided. As a specific example, when the ignition position was previously in an engine-running state, and has changed to an engine-off state, an engine deactivation indication is provided. Alternatively, an engine deactivation indication can be based on an engine shutdown command provided by the engine controller. In another example, engine deactivation can be inferred by observing various engine operating parameters. In one specific example, actual engine speed can be measured and compared to a minimum engine speed. Thus, as engine speed falls to below the minimum engine speed, an inference of engine shutdown is provided. As yet another example, an engine deactivation indication can be based on a supply voltage provided to the engine controller. In particular, when an ignition key is changed from the on to off position, supply voltage to the controller is removed and thus an indication of engine shutdown is provided.

When the answer to step 2010 is yes, the routine continues to step 2012. In step 2012, the compression ratio is set to a base variable compression ratio. The base variable compression ratio can be the desired compression ratio at engine start-up. Alternatively, it can be a default position to which the mechanism will revert to when hydraulic or electrical supply is removed. Note that the commanded base variable compression ratio can be a compression ratio position or a desired compression ratio.

Next, in step 2014, the routine adjusts control signals to move compression ratio to the desired compression ratio; this can be done by adjusting hydraulic control pressure, or by an electronic control signal to the compression ratio mechanism. Also, the adjusting step of 2014 can be delayed by a predetermined time period after the deactivation indication of step 2010.

Figure 21:
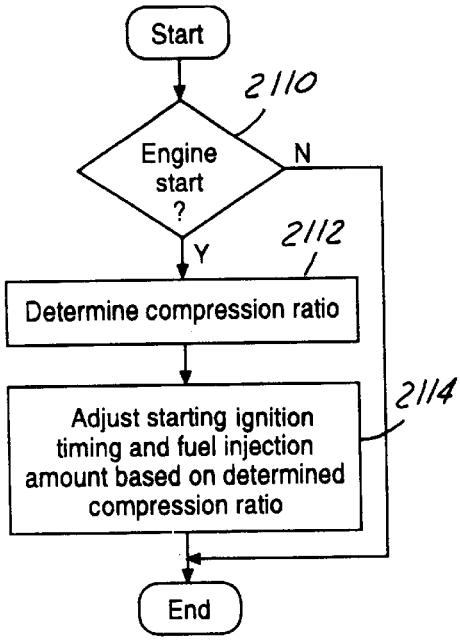
FIG. 21 shows a flow chart illustrating a routine for adjusting ignition timing in fuel injection amount during an engine start based on compression ratio.

Referring now to FIG. 21, a routine is described for adjusting ignition timing and fuel injection amount during an engine start based on compression ratio. In particular, the routine of FIG. 21 is used, if the routine described in FIG. 20 is not carried out. In other words, if the compression ratio was not moved to the base or starting compression ratio during an engine shutdown, the engine controller must compensate the ignition timing and fuel injection amount during an engine start depending on the start-up compression ratio. First, in step 2110, a determination is made as to whether it is an engine start. When the answer to step 2110 is yes, the routine continues to step 2112. In step 2112, the routine determines the current compression ratio. Then, in step 2114, the routine adjusts the engine start, ignition timing, and fuel injection amount based on the determined compression ratio.

Note that compression ratio can be estimated based on various engine-operating parameters. For example, compression ratio position (and therefore compression ratio) can be determined based on a hydraulic command signal. In other words, the controller can assume the actual compression ratio position corresponds to the commanded compression ratio position. Alternative, compression ratio can be inferred based on measured torque changes of the engine. Further, compression ratio can be estimated by observing air-fuel ratio errors. In particular, if the fuel injection amount is held constant and the compression ratio commanded to change, by examined measured exhaust air-fuel ratio a determination can be made as to whether actual compression ratio changed.

Note that there are various ways of injecting fuel that takes into account compression ratio. For example, fuel pulse width (FPW) can be directly modified by compression ratio. Alternatively, the fuel injection amount can be adjusted based on compression ratio. Alternatively, a cylinder air amount can be calculated based on compression ratio, and then this air amount used to calculated and inject fuel. Also, there are various ways to inject fuel based on a determined fuel amount. It can be done by converting fuel amount to a fuel pulse width (FPW), or by adjusting a voltage signal to inject the desired amount of fuel. Any method of actually injecting, or attempting to inject an amount of fuel requested is suitable for use with the present invention.

Figure 22:
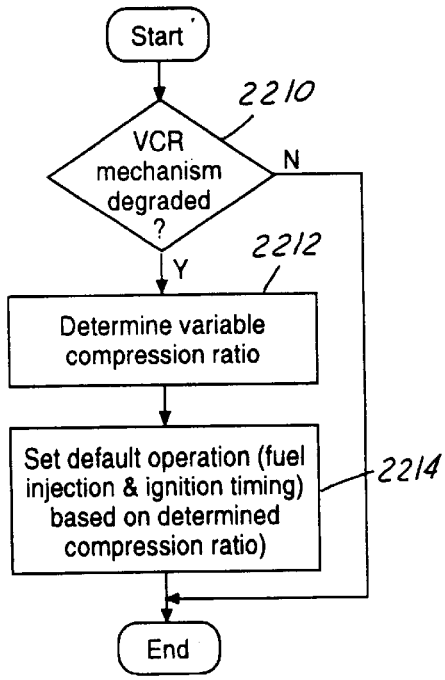
FIG. 22 shows a flow chart illustrating a routine for default operation if a variable compression ratio mechanism is in a degraded condition.

Referring now to FIG. 22, a routine is described for default operation if the variable compression ratio mechanism is in a degraded condition. First, in step 2210, a determination is made as to whether the variable compression ratio mechanism is degraded. For example, a determination is made as to whether the compression ratio mechanism is not following a desired trajectory. Alternatively, a determination can be made as to whether the compression ratio mechanism is remaining in a single position even though the desired position is changing. When the answer to step 2210 is yes, the routine continues to step 2212. In step 2212, the routine determines the current variable compression ratio. Then, in step 2214, the routine sets default operation of the fuel injection amount and ignition timing based on the determined default compression ratio position. In other words, the routine adjusts subsequent fuel injection amounts and ignition timing amounts to correspond to the current compression ratio. In this way, future engine starts can compensate for the compression ratio mechanism potentially not being in the base variable compression ratio position.

What is claimed is:

1. A method for operating an internal combustion engine, the engine having a variable compression ratio, the method comprising:

determining a fuel injection amount based on a parameter indicative of a compression ratio of the variable compression ratio engine; and injecting fuel into the engine based on said fuel injection amount, wherein said variable compression ratio engine is changed by changing connecting rod length between a reciprocating piston and a crankshaft of the engine.

2. The method recited in claim 1 wherein said parameter is an actual compression ratio of the engine.

3. The method recited in claim 1 wherein said parameter is an estimated compression ratio of the engine.

4. The method recited in claim 3 wherein said estimated compression ratio is based on a compression ratio command signal.

5. The method recited in claim 1 wherein said parameter is a measured position of a variable compression ratio unit of the engine.

6. The method recited in claim 1 wherein said determining further comprises:

calculating an engine air amount based on said parameter and an engine operating parameter; and calculating said fuel injection amount based on said calculated engine air amount.

7. The method recited in claim 6 wherein said engine-operating parameter is a manifold pressure.

8. The method recited in claim 6 wherein said engine operating parameter is at least one selected from the group consisting of engine speed, throttle position, engine airflow, and engine temperature.

9. The method recited in claim 1 wherein said injecting fuel into the engine based on said fuel injection amount further comprises injecting fuel into the engine based on said fuel injection amount, engine speed, engine temperature, and battery voltage.

10. The method of claim 1 wherein said fuel injection amount is further based on a recirculated gas amount.

11. The method of claim 1 wherein the engine has a two-position variable compression mechanism for controlling compression ratio.

12. A system comprising:

an internal combustion engine, the engine having a variable compression ratio, and a controller determining a fuel injection amount based on a parameter indicative of a compression ratio of the variable compression ratio engine and injecting fuel into the engine based on said fuel injection amount.

13. The system recited in claim 12 wherein said engine further comprises a variable compression ratio mechanism that varies said variable compression ratio of the engine.

14. The system recited in claim 12 wherein compression ratio is adjusted by changing effective piston length of the engine.

15. The system recited in claim 12 wherein compression ratio is adjusted by changing effective connecting rod length of the engine.

16. A method for operating an internal combustion engine, the engine having a variable compression ratio of the variable compression ratio engine, wherein said fuel injection amount is determined so as to maintain a desired air-fuel ratio and reduce exhaust gas emissions wherein said compression ratio is varied by changing connecting rod length between a reciprocating piston and a crankshaft of the engine; and injecting fuel into the engine based on a said fuel injection amount.

* * * * *